US005694101A

United States Patent [19]

Lavelle et al.

[11] Patent Number: 5,694,101

[45] Date of Patent: Dec. 2, 1997

[54] CIRCUIT BREAKER

[75] Inventors: Shay Joseph Lavelle, Westport; John Michael Mugan, Lisnalurge; James Joseph Shortt, Galway, all of Ireland; Kevin Michael Woods, Mount Vernon, Iowa

[73] Assignee: Square D Company, Palatine, Ill.

[21] Appl. No.: 593,314

[22] Filed: Jan. 31, 1996

[30] Foreign Application Priority Data

Feb. 1, 1995 [IE] Ireland ..... 950078

[51] Int. Cl.[6] ..... H01H 9/00

[52] U.S. Cl. ..... 335/172; 335/35

[58] Field of Search ..... 335/17, 35, 23–25, 335/167–76; 340/638, 639

[56] References Cited

U.S. PATENT DOCUMENTS

| | | | |
|---|---|---|---|
| 3,401,363 | 9/1968 | Vyskocil et al. | 335/17 |
| 4,166,989 | 9/1979 | Castonguay et al. | 335/17 |
| 4,975,673 | 12/1990 | Ikehata et al. | 335/17 |
| 5,003,139 | 3/1991 | Edds et al. | 335/17 |

*Primary Examiner*—Lincoln Donovan

*Attorney, Agent, or Firm*—Larry I. Golden; Kareem M. Irfan

[57] ABSTRACT

A circuit breaker (1) with a trip assembly (5) provided by an armature (7) carried on a yoke (6). The circuit breaker (1) trips in the event of a fault condition moving the yoke (6) and integrally formed flag section (8) so that an indicating flag section is visible through a window (15).

12 Claims, 4 Drawing Sheets

CIRCUIT BREAKER

FIELD OF THE INVENTION

The invention relates to a circuit breaker of the type comprising:

a circuit breaker housing having a line terminal, a load terminal, and a circuit trip assembly connected between the line terminal and the load terminal to trip the circuit in response to a fault condition;

the circuit trip assembly comprising:

a trip actuating yoke within the circuit breaker housing, an armature associated with the trip actuating yoke to trip the circuit breaker in the event of a fault condition, and an indicator flag means for indicating a circuit breaker tripped condition.

BACKGROUND OF THE INVENTION

Circuit breakers of this type are known. The circuit trip assemblies of such breakers are however relatively complex and involve a number of separate pieces which are assembled in the circuit breaker housing. Because of the number of different pieces and the complexity of such trip assemblies, it is very difficult to automate the assembly operation.

This invention is directed towards providing a circuit breaker which will overcome at least some of these difficulties.

SUMMARY OF THE INVENTION

According to the invention the indicator flag means is provided by portion of the trip actuating yoke.

Preferably the indicator flag means is integrally formed with the trip actuating yoke.

In a preferred embodiment the trip actuating yoke comprises:

a mounting section for mounting the yoke in the circuit breaker housing;

a trip actuating core section; and an indicator flag section defining the indicator flag means.

This obviates the need for a separate indicator flag assembly.

Ideally the indicator flag section comprises a flag arm having an indicating tab portion at a free end thereof, the indicating tab portion being viewable through a window in the circuit breaker housing. In this way, a circuit breaker which is tripped may be easily identified among a group of similar circuit breakers.

In a particularly preferred embodiment the trip actuating yoke is pivotally mounted to the circuit breaker housing for movement between a normal operating position and a tripped position.

Preferably a mounting section of the trip actuating yoke includes a mounting hole for pivotally mounting the yoke to the circuit breaker housing, thus allowing the circuit breaker to utilise an existing operating handle mechanism.

Ideally the trip actuating yoke is pivotally mounted on a mounting pin in the circuit breaker housing. Advantageously this allows the yoke to be easily mounted within existing circuit breaker housings and does not require design or manufacturing modifications.

In one arrangement the trip actuating yoke defines engagement means for engaging the armature thereby ensuring that the armature is carried close to the trip actuating yoke.

Preferably the armature engagement means is provided in the trip actuating core section of the trip actuating yoke. Ideally the armature engagement means is defined by an armature receiving recess. Thus, the engagement means is provided in a simple manner.

In one embodiment the trip actuating yoke includes bimetal alignment means for aligning the trip actuating yoke and a bimetal. This beneficially allows the circuit breaker to be protected against a thermal overload by a part which is easy to assemble.

Ideally a coil is provided around the trip actuating core, thereby further minimising the number of components required by removing the need for a solenoid and core arrangement.

Preferably, the coil is provided by a braided pigtail which is electrically connected to the line and load terminals. This arrangement ensures that the electrical connection between the line and load terminals is easy to weld into position and is flexible, facilitating insertion into the circuit breaker housing.

OBJECTS OF THE INVENTION

The present invention is directed towards combining the yoke and flag and producing it as a single unit.

Another advantage is that by combining the yoke and indicator flag as a single unit it may be assembled simultaneously reducing the number of assembly operations necessary.

These and other features, advantages and objects of the invention will be more clearly understood from the following description thereof, given by way of example only with reference to the accompanying drawings.

DETAILED DESCRIPTION OF THE PREFERRED EMBODIMENT

Figure 1:
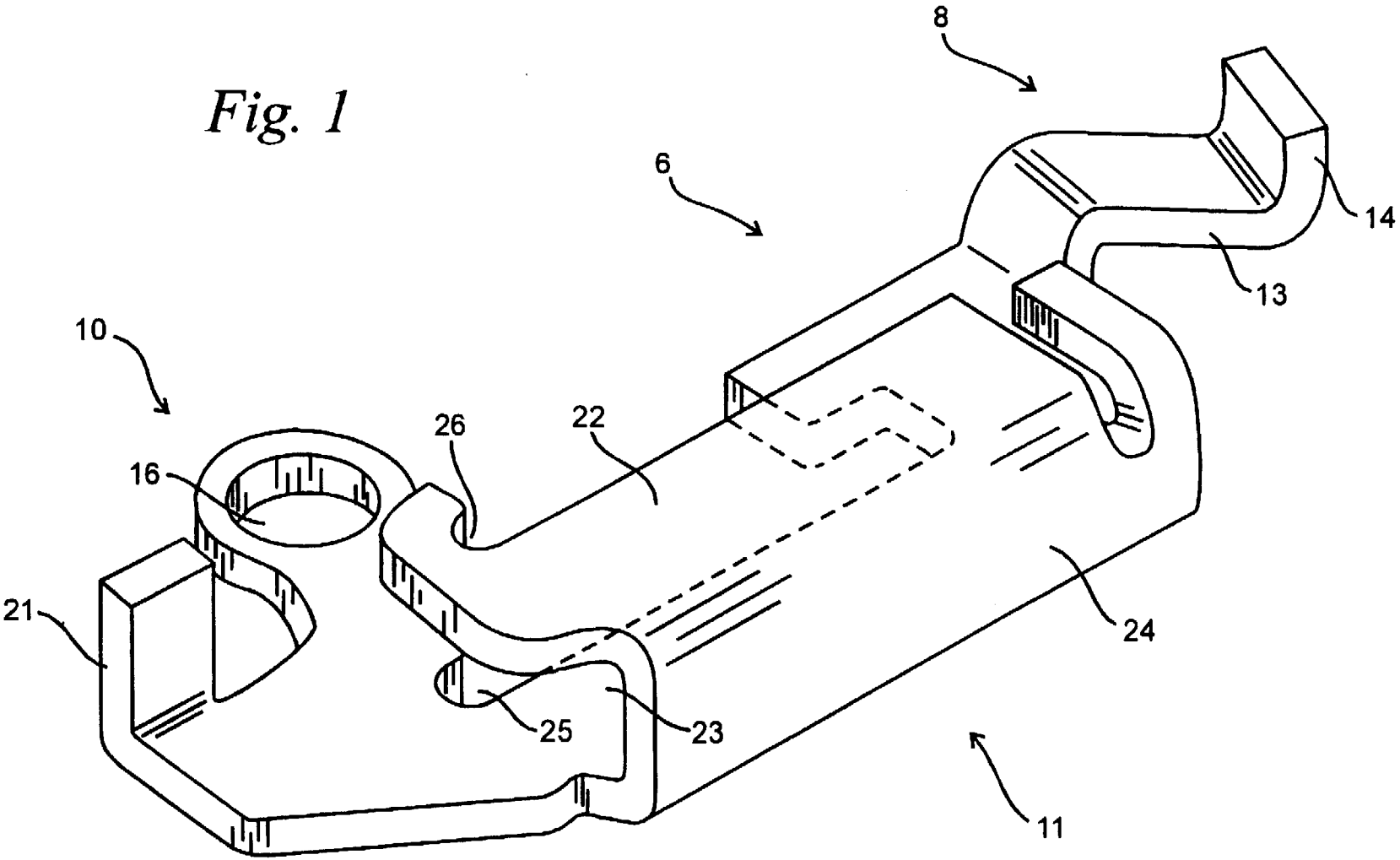
FIG. 1 is a perspective view of a trip actuating yoke forming part of a circuit trip assembly according to the invention.

Referring to the drawings there is illustrated a circuit breaker according to the invention indicated generally by the reference numeral 1. The circuit breaker 1 has a housing 2, a line terminal 3, a load terminal 4 and a circuit trip assembly 5 connected between the line terminal 3 and the load terminal 4.

The trip assembly 5 comprises a trip actuating yoke 6, an armature 7 carried on the yoke 6 to trip the circuit breaker 1 in the event of a current surge condition, and an indicator flag section 8 integrally formed with the yoke 6 for indicating a circuit breaker tripped condition.

In more detail and referring particularly to FIG. 1 the yoke 6 has a mounting section 10 for mounting the yoke 6 in the circuit breaker housing 2, a trip actuating core section 11 and an indicator flag section 8.

The indicator flag section 8 has a flag arm 13 with an indicating tab portion 14 at the free end thereof which is visible through a window 15 in the circuit breaker housing 2 in the circuit breaker tripped condition. The window 15 has an associated end stop 15*a* for positioning the indicating tab portion 14 in the circuit breaker tripped condition.

The mounting section 10 of the trip actuating yoke 6 defines a hole 16 for mounting the yoke 6 on a mounting pin 17 of the circuit breaker housing 2. The yoke 6 is pivotally movable about the mounting pin 17 between a normal operating position and the circuit breaker tripped position.

The mounting section 10 incorporates a bimetal alignment means provided by an upwardly extending lug 21 for aligning the yoke 6 and a bimetal 20. The lug 21 is formed for engaging the bimetal 20 in the event of a thermal overload.

The trip actuating core section 11 of the trip actuating yoke 6 has two spaced apart elongate side walls 22, 23 and an interconnecting end wall 24. Each side wall 22, 23 has an armature receiving recess 25, 26 for engaging the armature 7. The armature 7 is biased away from the yoke 6 by a leaf spring 9 anchored on the armature 7 and acting on the mounting pin 17.

The trip actuating core section 11 has a coil provided by a braided pigtail 29 wound about the end wall 24 and electrically connected to the line terminal 3 and the load terminal 4.

Figure 3:
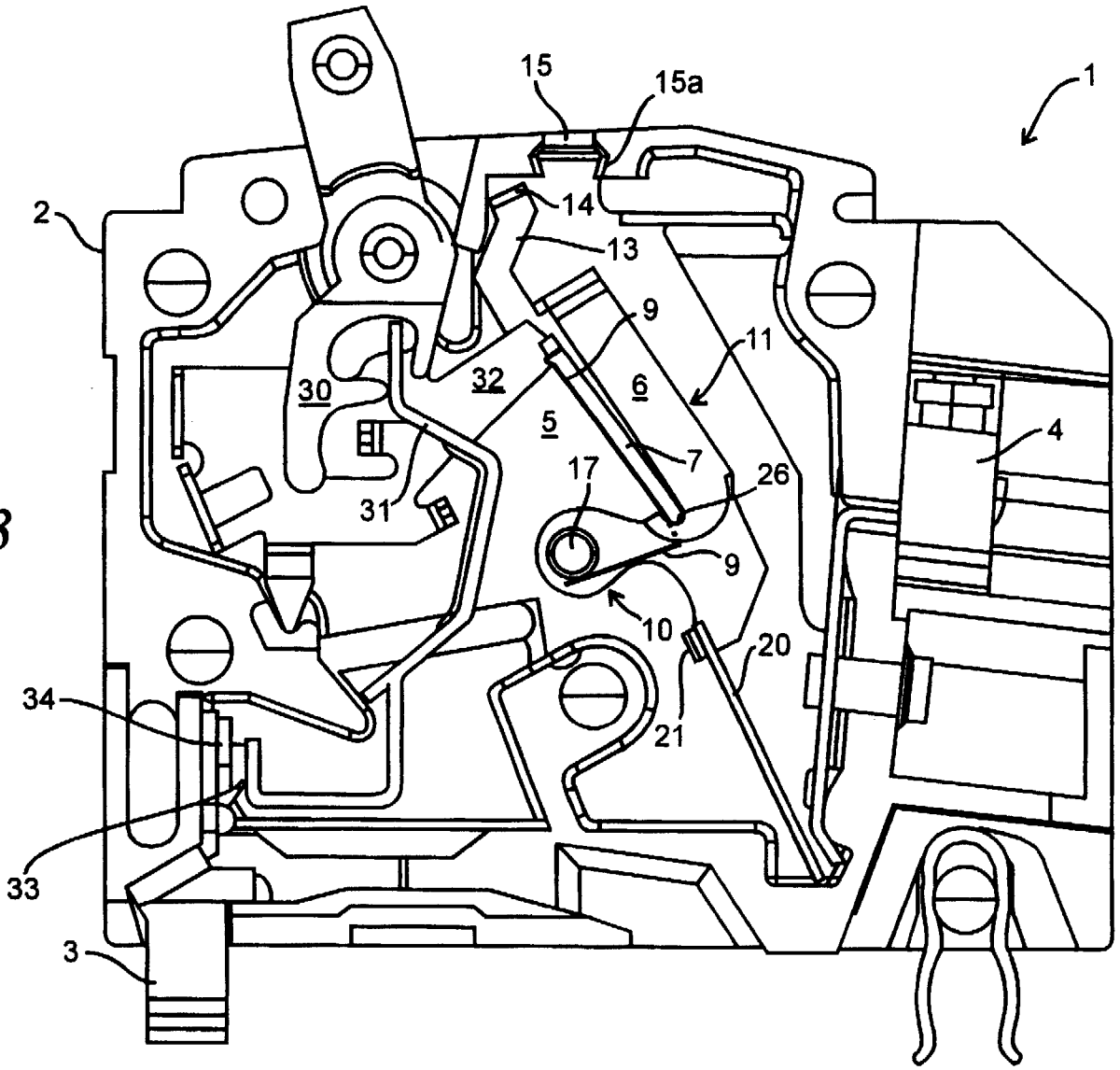
FIG. 3 is a plan view of the circuit breaker with the circuit trip assembly in an operating position.
Figure 4:
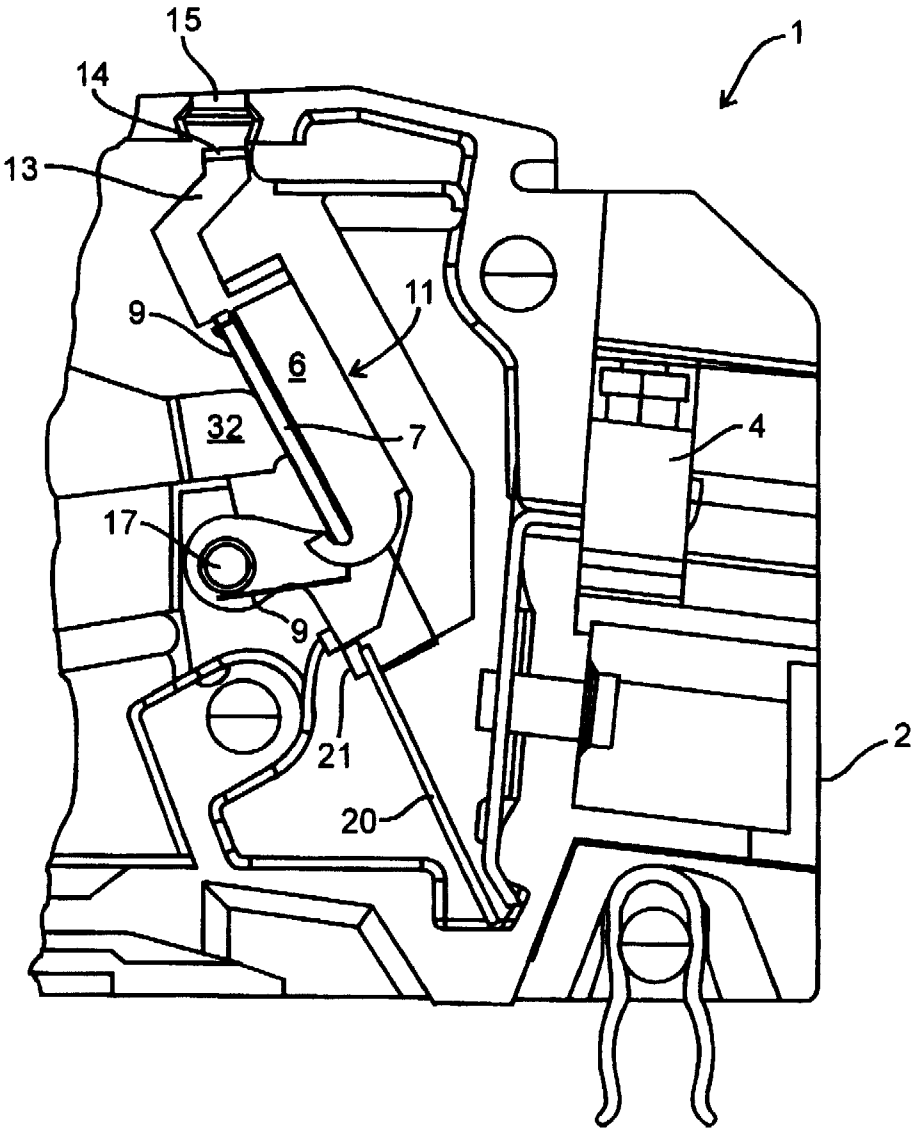
FIG. 4 is a plan view of a portion of the circuit breaker with the circuit trip assembly in a tripped position.

The circuit breaker 1 also has a operating handle mechanism 30 with a movable contact 33 carried on an arm 31 and engaging a fixed contact 34 connected to the line terminal 3. A trip lever 32 for engaging and biasing the armature 7 as shown in FIG. 3 is also provided.

Figure 2:
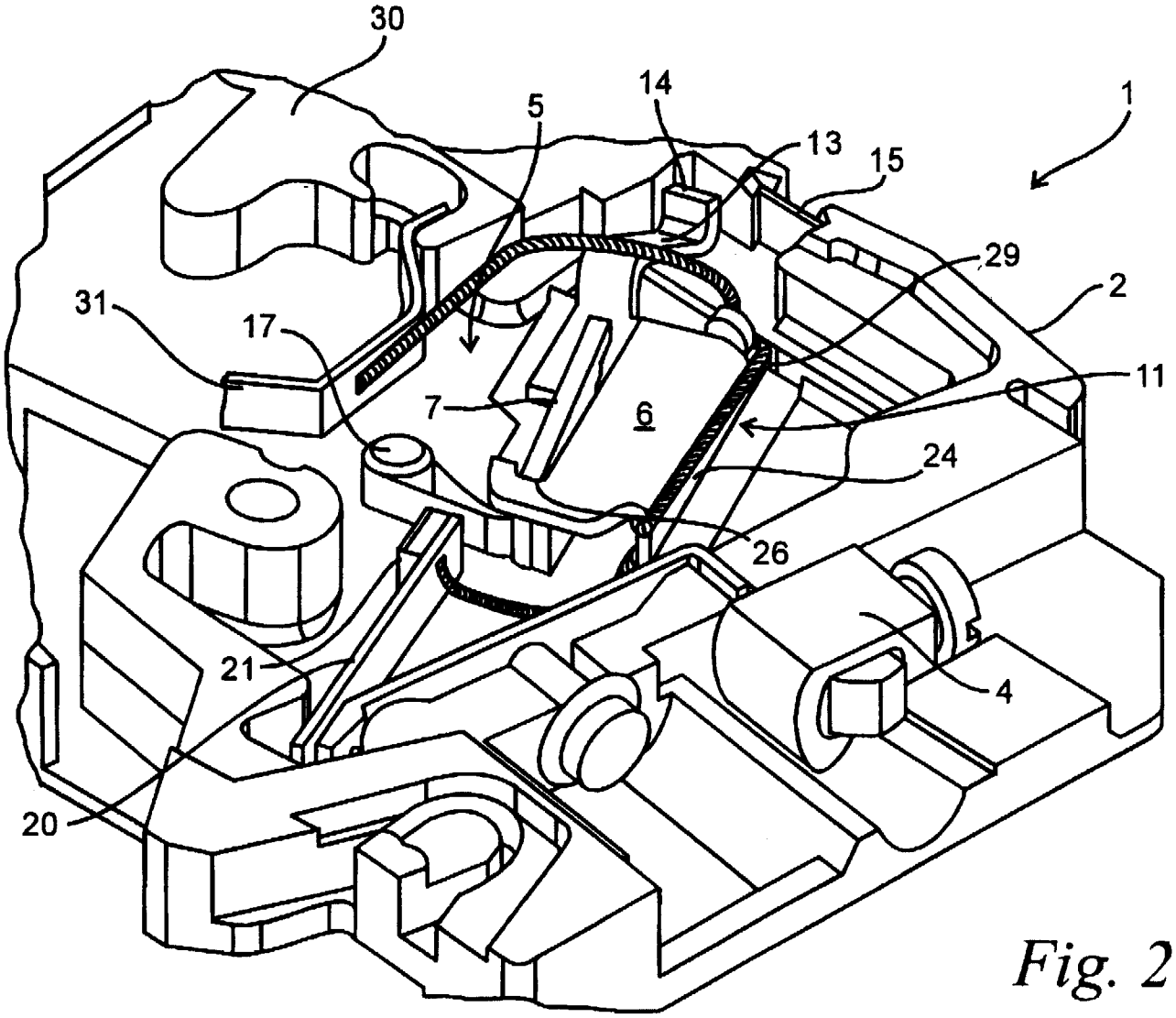
FIG. 2 is a perspective view of portion of a circuit breaker with the yoke of FIG. 1 in position.

In use, the circuit trip assembly 5 is mounted on the mounting pin 17 of the circuit breaker housing 2 as described above. In the normal operating position as illustrated in FIG. 3 the current path is from the line terminal 3 through the contacts 33,34 and the braided pigtail 29 (see FIG. 2) to the load terminal 4. The armature 7 is biased away from the yoke 6 by the leaf spring 9 and engages the trip lever 32.

The trip mechanism 5 may be tripped either by a thermal overload as detected by the bimetal 20 or by a current surge between the line terminal 3 and the load terminal 4. In the operating position, current passing through the braided pigtail 29 sets up an electromagnetic field around the trip actuating core section 11 of the trip actuating yoke 6 acting on the armature 7.

When the electromagnetic force is increased by a current surge, the armature 7 is magnetically drawn toward the trip actuating core section 11 by the increase in the electromagnetic field. This disengages the armature 7 from the trip lever 32 which then moves along the armature 7 to pivot the yoke 6 about the mounting pin 17. The circuit is thus broken by the movable contact 33 disengaging from the fixed contact 34. The pivotal movement of the yoke 6 moves the flag arm 13 until the indicating tab 14 is visible through the window 15 in the circuit breaker housing 2.

When a thermal overload condition occurs the deflection of the bimetal 20 pushes the lug 21 in clockwise rotation about the mounting pin 17, thus pivoting the yoke 6 and armature 7 to disengage from the trip lever 32, tripping the circuit breaker 1. Fur%her pivotal movement of the yoke 6 is limited by the indicating tab 14 making contact with the end stop 15*a*.

When the tripped condition occurs either by current surge or by thermal overload, the indicating tab portion 14 may be clearly seen through a viewing window 15 of the circuit breaker housing 2.

It will be appreciated that the combined yoke and indicator flag assembly of the invention is provided in a single piece having a common pivot point ensuring that material, manufacturing, and assembly costs are substantially reduced. Additionally, the leaf spring is no longer required to reset the indicator flag after a trip condition has occurred. It will also be appreciated that the gap between the armature 7 and the yoke side walls 22 and 23 is controlled by the extension leg of the yoke 6.

It will further be appreciated that any suitable biassing method may be used to move the yoke and flag assembly from the normal operating position to the tripped position.

It will also be appreciated that while the invention has been described with particular reference to one type of circuit breaker it has wide applications to many different types of circuit breaker.

It will further be appreciated that the size, shape and colour of the indicator flag may be varied to suit any given application.

Various changes, modifications and variations may be made to the arrangement described without departing from the scope of the invention.

What is claimed is:

1. A circuit breaker comprising:

a circuit breaker housing having a window, a line terminal, a load terminal, and a circuit trip assembly connected between the line terminal and the load terminal to trip the circuit in response to a current surge condition;

the circuit trip assembly comprising:

a trip actuating yoke within the circuit breaker housing, said yoke movable between a first position corresponding to a normal operating condition and a second position corresponding to a circuit breaker tripped condition, an armature associated with the trip actuating yoke to trip the circuit breaker in the event of a current surge condition, said yoke including an integrally extending flag section having an indicating tab portion which is visible through said window when said yoke is in said second position and not visible through said window when said yoke is in said first position.

2. A circuit breaker as claimed in claim 1 wherein the indicator flag section comprises a flag arm having said indicating tab portion at a free end thereof.

3. A circuit breaker as claimed in claim 1 wherein the trip actuating yoke is pivotally mounted to the circuit breaker housing for movement between a normal operating position and a tripped position.

4. A circuit breaker as claimed in claim 3 wherein a mounting section of the trip actuating yoke includes a mounting hole for pivotally mounting the trip actuating yoke to the circuit breaker housing.

5. A circuit breaker as claimed in claim 4 wherein the trip actuating yoke is pivotally mounted on a mounting pin in the circuit breaker housing.

6. A circuit breaker as claimed in any of claim 1 wherein the trip actuating yoke defines engagement means for engaging the armature.

7. A circuit breaker as claimed in claim 6 wherein the armature engagement means is provided in the trip actuating core section of the trip actuating yoke.

8. A circuit breaker as claimed in claim 7 wherein the armature engagement means is defined by an armature receiving recess.

9. A circuit breaker as claimed in claim 1 wherein the trip actuating yoke includes bimetal alignment means for aligning the trip actuating yoke and the bimetal.

10. A circuit breaker as claimed in claim 1 wherein a coil is provided around the trip actuating yoke.

11. A circuit breaker as claimed in claim 10 wherein the coil is provided by a braided pigtail which is electrically connected between the line and load terminals.

12. A circuit breaker as claimed in claim 2 wherein said circuit breaker housing includes an end stop positioned adjacent said window which limits further movement of said yoke by engaging said end tab when said yoke is in said second position.

* * * * *